US005186797A

United States Patent [19]

Schlenker et al.

[11] Patent Number: 5,186,797

[45] Date of Patent: Feb. 16, 1993

[54] METHOD AND SYSTEM FOR REMOVING RESIN BLEED FROM ELECTRONIC COMPONENTS

[75] Inventors: Heinz W. Schlenker, Northridge; Louis J. Hirbour, Yorba Linda; Daniel J. Gramarossa, Oakhurst, all of Calif.

[73] Assignee: Future Automation, Inc., Simi Valley, Calif.

[21] Appl. No.: 640,053

[22] Filed: Feb. 13, 1991

[51] Int. Cl.[5] ..... C25F 5/00; C25F 7/00; C25D 17/28

[52] U.S. Cl. ..... 204/146; 204/203; 204/226; 204/227

[58] Field of Search ..... 204/141.5, 146, 207, 204/208-210, 202-205, 226, 227

[56] References Cited

U.S. PATENT DOCUMENTS

| | | | |
|---|---|---|---|
| 4,508,611 | 4/1985 | Johnson et al. | 204/202 |
| 4,534,843 | 8/1985 | Johnson et al. | 204/202 |
| 4,859,298 | 8/1989 | Senge et al. | 204/202 X |
| 4,906,345 | 3/1990 | Gramarossa et al. | 204/203 X |
| 4,966,664 | 10/1990 | Buerk et al. | 204/146 |
| 4,968,397 | 11/1990 | Asher et al. | 204/146 X |
| 4,968,398 | 11/1990 | Ogasawara | 204/146 |

*Primary Examiner*—Donald R. Valentine
*Attorney, Agent, or Firm*—Hale and Dorr

[57] ABSTRACT

Disclosed is an in-line electrolytic deflash system and method for removing resin bleed and other materials from the leads of an encapsulated electronic component. An encapsulated electronic component is carried on a continuous belt through the system. The component first passes through an electrolytic deflash station which includes tanks filled with a deflash solution for loosening the resin bleed. The component is then rinsed in a low pressure rinse station, and then carried through a high pressure rinse station where the loosened resin bleed is removed from the component. The component is then further rinsed with both tap water and a deionized water. Once the component has been sufficiently rinsed any remaining moisture is blown off the part in an air knife station and the component is then passed through a dryer which completely removes any moisture remaining on the component.

6 Claims, 6 Drawing Sheets

METHOD AND SYSTEM FOR REMOVING RESIN BLEED FROM ELECTRONIC COMPONENTS

BACKGROUND OF THE INVENTION

The present invention is directed to a system and method for removing resin bleed from an encapsulated electronic component and more particularly to a system and method for removing resin bleed from the encapsulated electronic component as the component continuously moves along through the system.

Since the early 1970s delicate electronic components (such as integrated circuit chips) have been encapsulated in electrically insulating bodies from which only contact elements necessary to communicate to others portions of a completed circuit protrude. It is particularly advantageous to create such insulating bodies by dipping the component to be protected into a thermoset plastic resin. The resin, however, often coats more than the electronic circuit or drips onto the leadframe of the electronic circuits. In other words, this resin ends up coating part of the leads for the electronic circuit, and such excess resin is referred to herein as "resin bleed". Resin bleed must be removed from the leads prior to any later manufacturing processes, such as the electroplating of the leads.

Various methods for removing resin bleed have been tried. Chemical deflashing uses a chemical solution which will dissolve or otherwise remove the resin bleed from the leads. Traditionally, M-Pyrol has been used in chemical deflashing. Use of M-Pyrol, however, has been known to cause many in-house fires due to its flammability and high operating temperatures. Therefore, chemical deflashing has dangerous side effects.

Another type of deflashing equipment has been used in which a high pressure liquid with a mixture of fine glass or sand media is sprayed at the leadframe in order to remove the resin bleed. This type of deflashing, which is known as "media deflashing" or "media blasting", however, also presents problems because the media gets imbedded in the leadframe, the media is expensive and the solution with the media is a contaminated solution which must be properly discarded. Once the media deflashing equipment was automated to a production capacity of approximately 700 cut strips per hour the use of M-Pyrol was significantly reduced.

During the 1980's, both chemical deflashing and media blasting were used either alone or in combination to remove resin bleed. In both type of systems, a significant amount of handling is required because the encapsulated electronic components are batch loaded into either type of system. Once the components are processed in such a system they are then generally taken to rinse stations and drying stations. This processing is therefore slow and requires human intervention to load the leadframes into the various other process stations.

It is therefore a principal object of the present invention to provide an in-line system and method for removing plastic resin bleed from a metallic leadframe of an encapsulated electronic component following the molding of the component without the need for human intervention.

It is a further object of the present invention to provide a system and method for continuously processing a succession of encapsulated electronic components in order to remove resin bleed from their metallic leadframes.

A still further object of the present invention is to provide a system and method for removing resin bleed from encapsulated electronic components which can be used either in-line with other production equipment or as a stand alone system.

SUMMARY OF THE INVENTION

The in-line electrolytic deflash system and method of the present invention removes resin bleed and other materials from the leads of an encapsulated electronic component. An encapsulated electronic component is carried on a continuous belt through the system. The component first passes through an electrolytic deflash station which includes at least one tank filled with a deflash solution for loosening the resin bleed. The component is then rinsed in a low pressure rinse station, and then carried through a high pressure rinse station where the loosened resin bleed is removed from the component. The component is then further rinsed with both tap water and a deionized water. Once the component has been sufficiently rinsed any remaining moisture is blown off the part in an air knife station, and the component is then passed through a dryer which completely removes any moisture remaining on the component.

These and other objects and features will be more fully described below in connection with the various figures in which corresponding reference numerals refer to corresponding parts throughout the several views.

DETAILED DESCRIPTION OF THE PREFERRED EMBODIMENT

Figure 1:
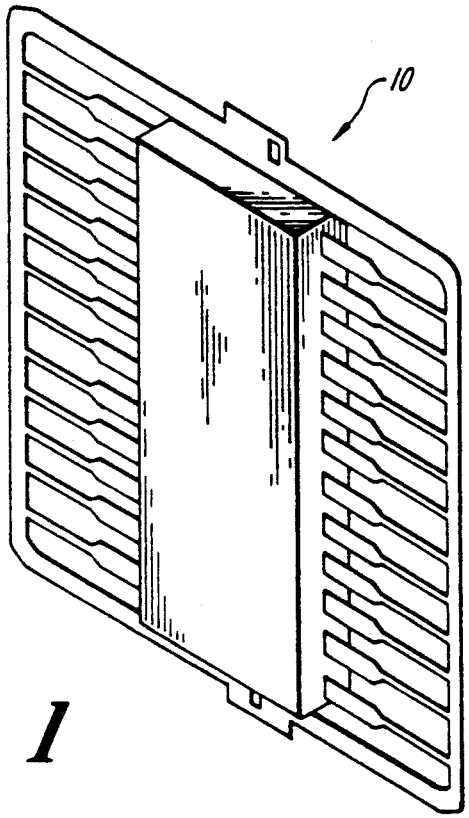
FIG. 1 is a perspective view of an encapsulated electronic component.
Figure 2:
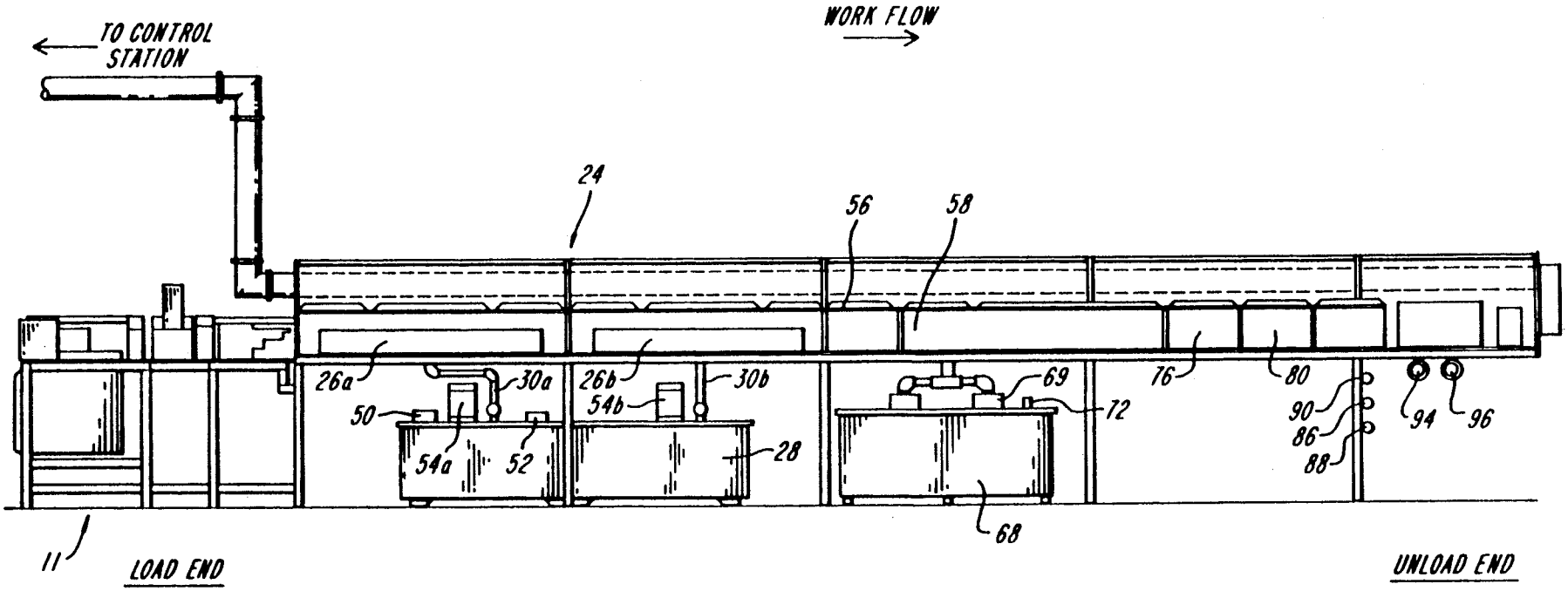
FIG. 2 is a front plan view of a preferred embodiment of the in-line system for removing resin bleed from the leadframe of an encapsulated electronic component of the present invention.

Referring to FIG. 2, the automatic deflash system of the present invention is fed electronic encapsulated components, an example of which is shown in FIG. 1, from either another component processing system when the deflash system is connected to such a system as part of a complete in-line system for molding semiconductor packages or from an operator when the deflash system is used as a stand along unit.

The encapsulated electronic components 10 are loaded in the load station 11 onto a continuous conveyor belt 12 which will transport the components 10 throughout the entire system. The belt may be of any type traditionally used in connection with the production of encapsulated electronic circuits. In a preferred embodiment the belt 12 is an endless belt propelled in a continuous aligned loop. The belt proper 14 is constructed from a metallic alloy, preferably a stainless steel with high yield strength which is shaped into a flat web of considerable length, minimal thickness and a width adapted to the particular system. The web is formed into a continuous conveyor belt with its width in a substantially vertical plane. The bottom of the conveyor belt is provided with grip means 16, comprised of adjacent, double-bent fingers 18 of alternating asymmetrical shape which can interact to grip planar components pressed between adjacent flexible grip fingers. A belt of this type is described in detail in U.S. Pat. No. 4,534,843, the teachings of which are incorporated herein by reference.

The encapsulated electronic components 10 are then sequentially carried through a series of in-line process stations which remove resin bleed from the leadframes and then clean and dry the leadframe. The first such process station is the electrolytic deflash station 24, which in the embodiment shown in FIG. 2 is made up of a first electrolytic deflash tank 26*a* and a second electrolytic deflash tank 26*b*. Deflash tanks 26*a*, 26*b* are fed an electrolytic solution from a solution reservoir 28 through feed pipes 30*a*, 30*b*. The reservoir 28 is dedicated solely to supplying electrolytic solution to the deflash tanks 26*a*, 26*b*, and the reservoir recirculates the solution and heats it as well.

The solution that is used in the electrolytic deflash tanks 26*a*, 26*b* is a dipotassium phosphate solution. One gallon of such solution would be prepared by starting with ¾ gallon of water to which 1 pound of dipotassium phosphate is added. 188 milliliters of glycerine (5% v/v) is then added followed by 63.2 grams of a nonionic surfactant which is a polyoxyethylene polyoxypropylene block copolymer of about 900 average molecular weight. Next, 24.5 grams of another nonionic surfactant which is a polyoxyethylene polyoxypropylene block copolymer of about 3000 average molecular weight, is then added. The solution is mixed thoroughly after the addition of each of these chemicals. It is envisioned that others skilled in the art could use other similar ingredients to obtain a suitable solution.

Figure 5:
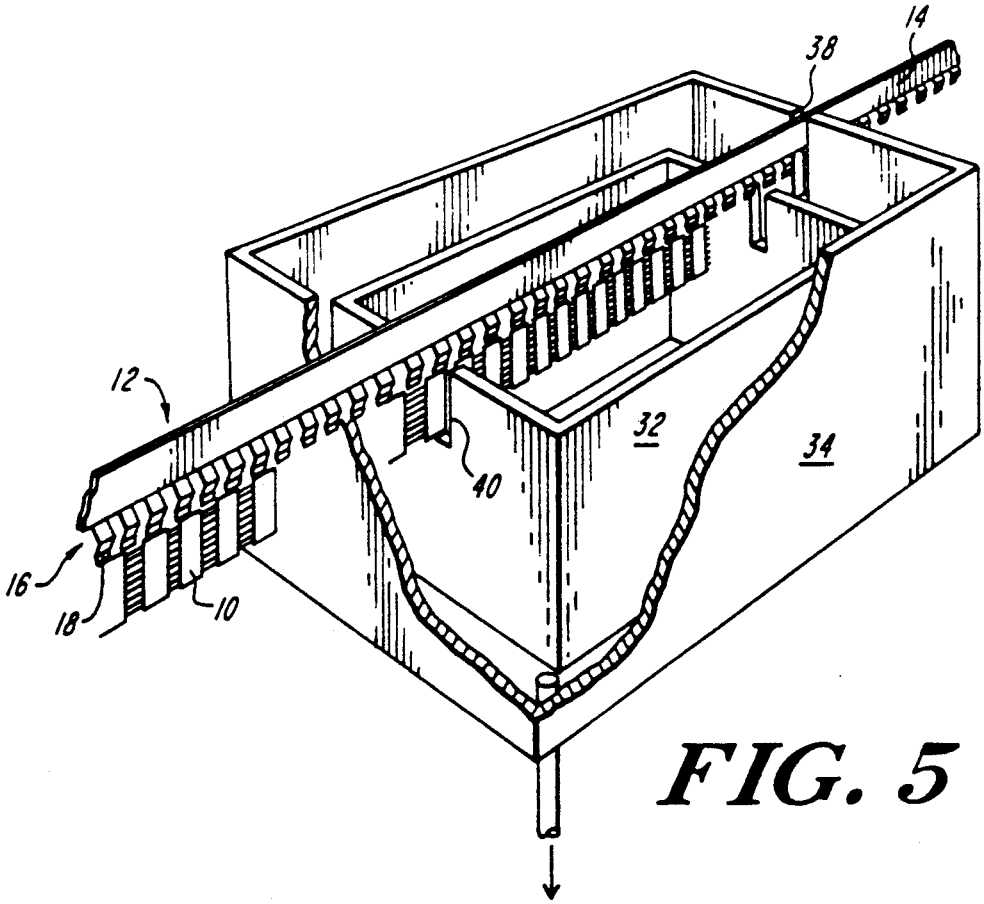
FIG. 5 is a perspective view of the electrolytic deflash station shown in FIGS. 3 and 4.
Figure 3:
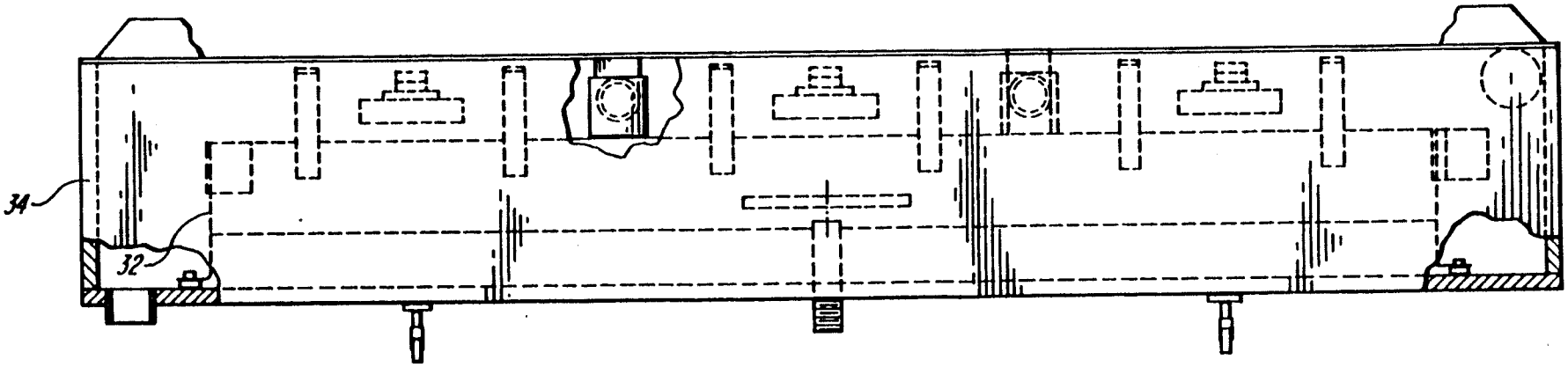
FIG. 3 is a side plan view of the electrolytic deflash cell of the system shown in FIG. 2.
Figure 4:
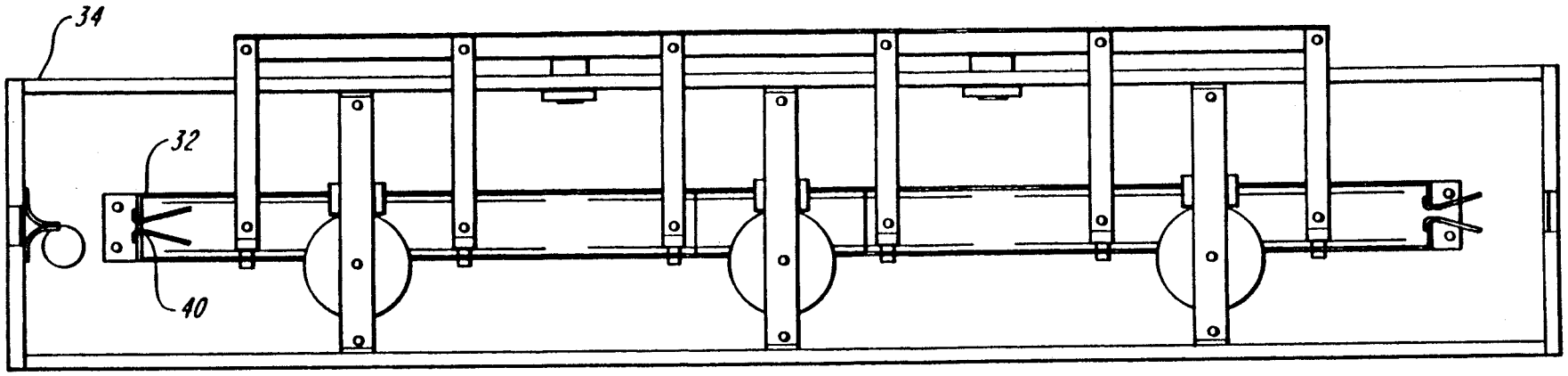
FIG. 4 is top view of the electrolytic deflash cell shown in FIG. 3.

The electrolytic deflash tanks 26*a*, 26*b*, shown in FIGS. 3–5, are made up of an inner cell 32 and an outer cell 34. The belt 12 carrying the encapsulated components 10 travels through an opening 38 in the outer cell 34 and runs superposed over a weir 40 at the entrance to the inner cell 32 allowing the components 10 suspended therefrom to pass through the inner cell 32 below the surface level of the deflash solution contained therein. A similar weir 40 at the opposite end of the inner cell 32 permits the exit of the conveyor and the carried components without a change in their vertical position.

The outer cell 34 acts as an overflow container for the inner cell 32. The deflash solution contained within inner cell 32 flows through the weirs into the outer cell 34 and by means of a conduit 42 to a recirculating pump 54*a*, 54*b*. The pump returns the fluid to the inner cell 32 after the deflash solution has been filtered. Pumping action also serves to maintain a high degree of agitation within the tank in order to insure the chemical uniformity of the deflash solution. A tank construction of this type is described in detail in U.S. Pat. No. 4,534,843 which has already been incorporated herein by reference.

It has been determined that a leadframe will have to be immersed in the deflash solution for a minimum of 30 seconds in order to loosen the resin bleed. Depending upon the desired throughput, the deflash tanks must therefore be constructed of a length in the machine direction sufficient to enable the components to be immersed for a sufficient length of time. Due to manufacturing problems, it is often necessary to use two electrolytic deflash tanks as shown in the preferred embodiment of FIG. 2. In this embodiment which has a desired throughput rate of 1200 units per hour the encapsulated electronic component is immersed in each tank for 18 seconds. The tanks 26*a*, 26*b* are constructed to be five feet in length and the belt 12 travels ten inches in every three seconds. A new leadframe is loaded onto the belt every three seconds and therefore in the embodiment shown in FIG. 2 the component is actually immersed in the tank for a total of 36 seconds.

In the preferred embodiment, the dipotassium phosphate deflash solution is heated to 160° F. The gripper belt 12, which transports the component 10, becomes the cathodic connection while opposing metallic plates, submersed in the solution on both sides of the leadframe, serve as the anodic connection. A rectifier 46 in each tank supplies high amperage DC current, thereby causing the formation of hydrogen gas on the surface of the semiconductor leadframe by electrolytic action. The formation of these gases causes the plastic resin bleed from the molding operation to be loosened from the metallic leadframe.

As described above, the resin bleed loosening solution which is stored in the reservoir 28 is heated in the reservoir. Heater 50 is provided for this purpose. A level sensor 52 monitors the level of the solution in the reservoir 28 and circulation pumps 54*a* and 54*b* are used to pump the solution from the reservoir to the deflash tanks 26*a*, 26*b* respectively.

After the encapsulated electronic component 10 has passed through the electrolytic deflash stage of the system, it passes through a first rinse station 56 which rinses off any deflash solution remaining on component 10 or the carrier belt 12. In the preferred embodiment, the rinse station 56 includes a housing in which two opposing manifolds having four spray nozzles direct a liquid spray (preferably tap water) from the nozzles to the component leadframe to rinse off the deflash solution. The spray nozzle manifolds are fed by water supply lines at the facility where the system is installed, preferably at a regulated pressure of 30 psi.

Figure 6:
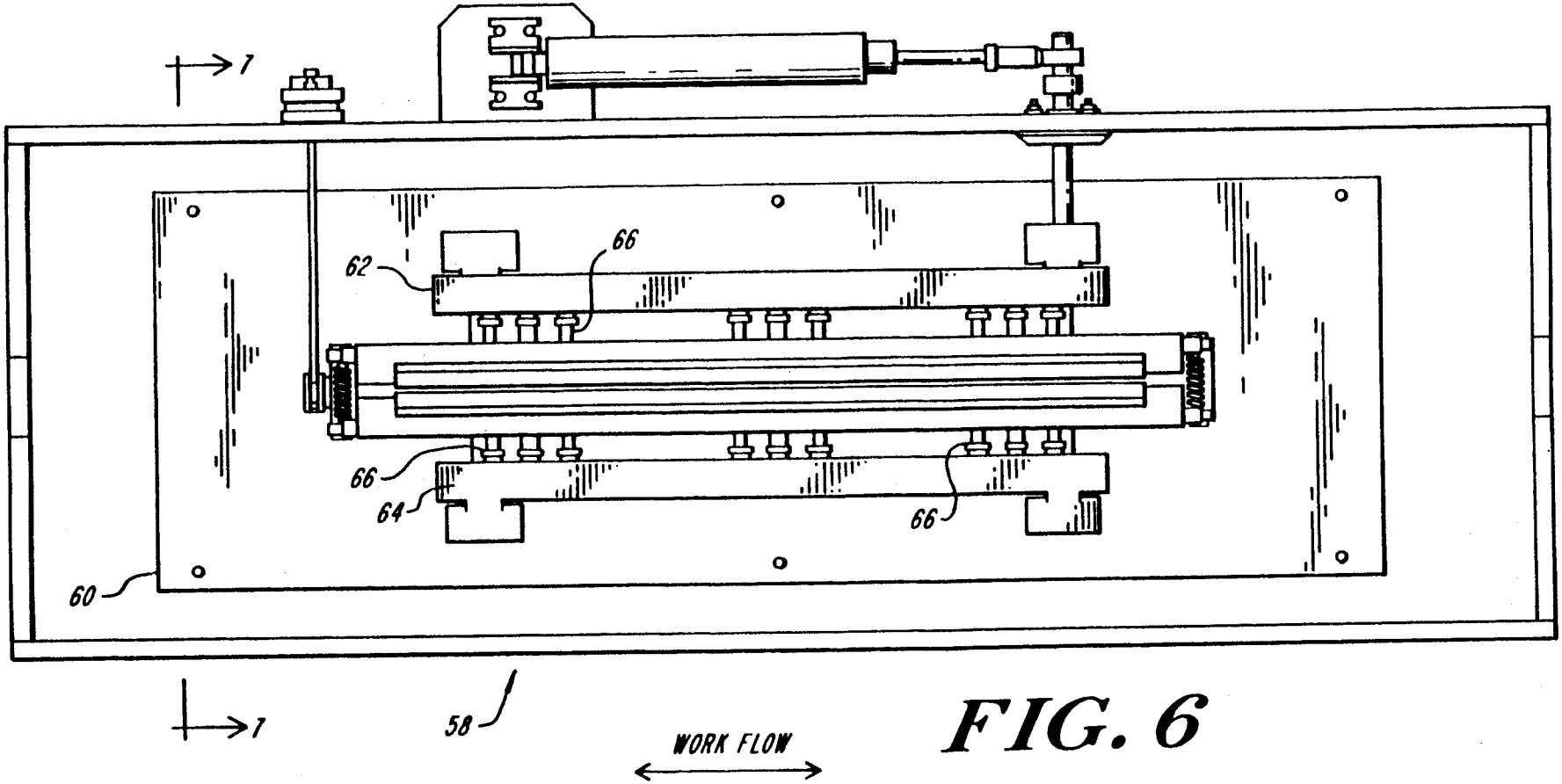
FIG. 6 is a top plan view of the high pressure rinse cell of the system shown in FIG. 2.
Figure 7:
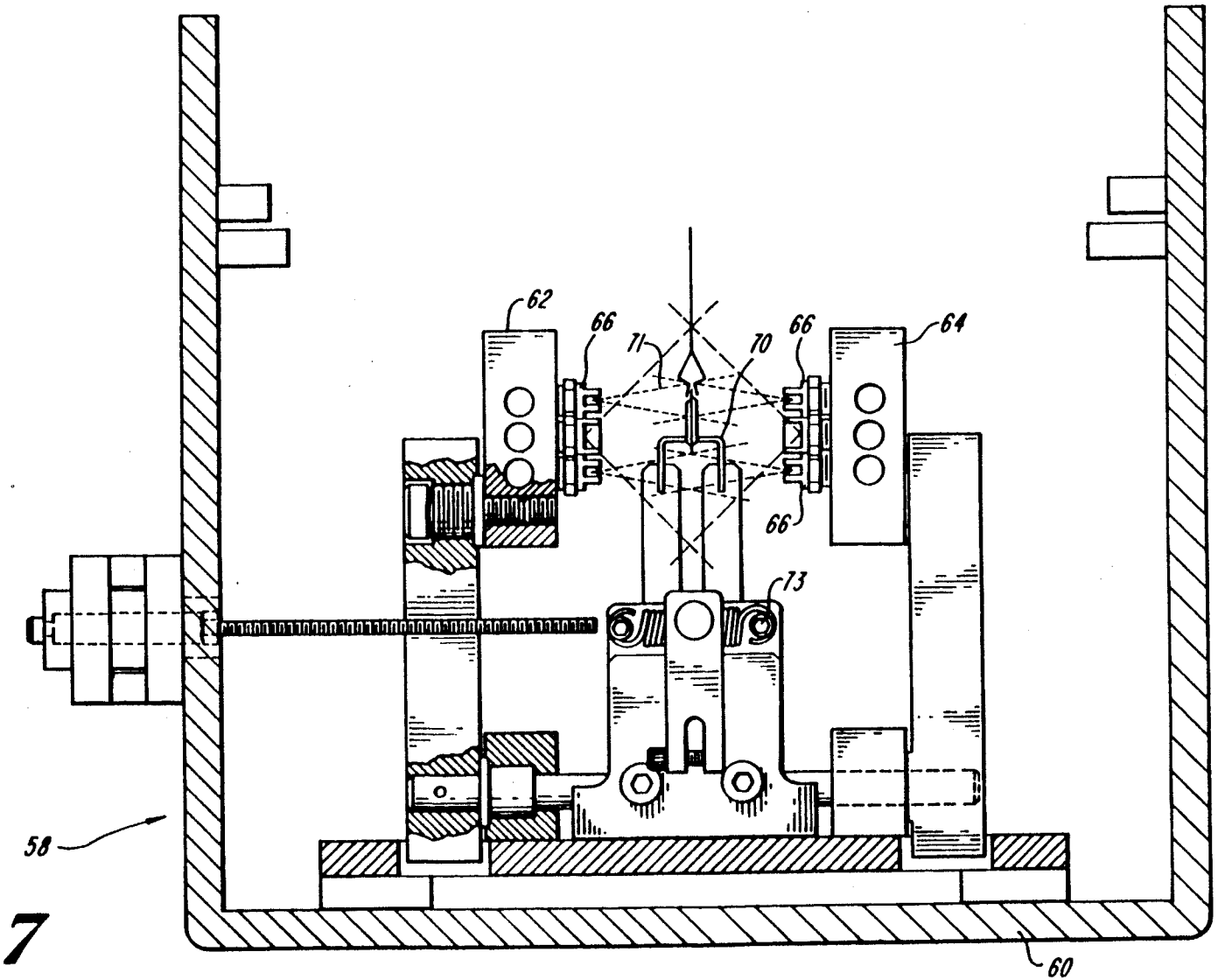
FIG. 7 is a sectional view taken along lines 7—7 of FIG. 6.

After passing through rinse station 56, the encapsulated electronic components 10 are then carried to a high pressure spray rinse station 58 designed to remove the resin bleed and other excess material loosened in the electrolytic deflash station. In the preferred embodiment shown in FIGS. 6 and 7, the high pressure spray rinse station 58 includes a housing 60 which includes two manifolds 62, 64 and twenty-four (24) spray nozzles 66 connected to the manifolds 62, 64 with twelve spray nozzles being connected to manifold 62 and twelve spray nozzles being connected to manifold 64. These manifold assemblies 62, 64 are supplied with water from a recirculating reservoir 68 which delivers water via a high pressure pump 69. In the preferred embodiment two such pumps 69 are provided for each manifold set and water is preferably delivered by these spray nozzles at 500 psi.

The lead frame 10 when travelling through station 58 is supported between the manifolds with either an adjustable guide or an adjustable clamp mechanism 70 which is adjusted by a screw 73. With the leadframe properly supported, the manifold assemblies mechanically oscillate in a vertical plane to completely blanket the leadframe with high pressure spray 71 in order to remove the deflash solution and the plastic resin bleed loosened by the electrolytic deflash solution.

The high pressure pumps are preferably enclosed in a sound insulator housing to reduce noise and are plumbed with regulators to adjust the pressure. The reservoir 68 is equipped with dual sediment filters to catch the removed resin and allow easy cleanout without process interruption. The reservoir 68 is further equipped with an automatic refill valve 72 to flush itself out on a regular basis to avoid collection of debris.

From the high pressure spray rinse station 58, the encapsulated electronic component 10 is then carried to a second spray rinse station 76 which is intended to remove any particulate matter that may have settled back on the leadframes. This station 76, as in the case of first rinse station 56, includes a housing in which two opposing manifolds with four spray nozzles each are positioned so that the component passes between the manifold. The nozzles direct a spray of water at the leadframes to remove any excess deflash or particulate matter. The spray nozzle manifolds are fed by water supply lines at regulated pressure of 30 psi.

The encapsulated electronic components 10 travel from the spray rinse station 76 to a hot deionized water rinse station 80 in which a high purity rinse is used to remove any process residues still remaining on the leadframe. In the station, as in stations 56, 76, the liquid (which in this case is deionized water) is pumped at 30 psi and is fed to two opposing manifolds with four spray nozzles each. The deionized water will further clean the leadframe and will also facilitate drying. Finally, the use of deionized water leaves the leadframe spot free.

After leaving the hot deionized water rinse station 80, the component 10 travels through air knife station 84 which includes two opposing curtains of air for blowing moisture off of the component. Air nozzles on one side of the component are supplied air at 50 psi whereas air nozzles on the other side of the component supply air at 1 to 2 psi. Siphoning valves 86,88 are provided to control the supply of deionized water for use in the hot deionized rinse station, and a siphoning valve 90 is provided to control the water supply to the rinse station 56,76.

Finally, the encapsulated electronic component 10 which still may include a small amount of moisture is carried through a hot air dryer 92 which completely dries the component prior to the unloading of the component from the belt 12. Two hot air dryers 94, 96 pump the hot air at approximately 250° F. into the dryer.

The component is now ready to be unloaded from the gripper belt 12 or will continue to travel into a plating system if a plating system is connected to the output end of the resin bleed removal system.

While the foregoing invention has been described with reference to its preferred embodiments, various alterations and modifications will occur to those skilled in the art. For example, it is envisioned that one or more of the rinse stations could be removed from the system without a significant deterioration in system performance. All such alterations and modifications are intended to fall within the scope of the claims.

What is claimed:

1. An in-line electrolytic deflash system for removing resin bleed and other material from the leadframe of an encapsulated electronic component, said system comprising:

means for transporting said encapsulated electronic component through said system;

means for electrolytically loosening said resin bleed on the leadframe of said encapsulated electronic component by passing said encapsulated electronic component through a resin bleed-loosening solution;

means for rinsing said encapsulated electronic component after said encapsulated electronic component has been passed through said solution in order to remove said solution and resin bleed from said encapsulated electronic component, said means for rinsing including:

at least one low pressure rinse station for rinsing said resin bleed loosening solution from said encapsulated electronic component;

at least one high pressure rinse station and a plurality of nozzles positioned within said station for spraying a liquid under a high pressure at both sides of said encapsulated electronic component to remove resin bleed and resin bleed loosening solution from a leadframe of said encapsulated electronic component.

2. The in-line electrolytic deflash system of claim 7 wherein at least a portion of said plurality of nozzles oscillates in a vertical plane to enable said nozzles to completely blanket the encapsulated electronic component with said high pressure liquid spray.

3. A method for removing resin bleed and other material from the leadframe of an encapsulated electronic component, said method comprising the steps of:

loading said encapsulated electronic component onto a transporting member for transporting said encapsulated electronic component through the steps of said method;

causing formation of hydrogen gas on a surface of said leadframe as said encapsulated electronic component is passed through a resin bleed-loosening solution in order to electrolytically loosen said resin bleed on the leadframe of said encapsulated electronic component;

rinsing said encapsulated electronic component after said encapsulated electronic component has been passed through said resin bleed-loosening solution comprised of dipotassium phosphate heated to a temperature of approximately 160° F. to remove said solution and said resin bleed from said encapsulated electronic component.

4. A method for removing resin bleed and other material from the leadframe of an encapsulated electronic component, said method comprising the steps of:

loading said encapsulated electronic component onto a transporting member for transporting said encapsulated electronic component through the steps of said method;

passing said encapsulated electronic component through a resin bleed-loose solution in order to electrolytically loosen said resin bleed on the leadframe of said encapsulated electronic component;

rinsing said encapsulated electronic component after said encapsulated electronic component has been passed through said resin bleed-loosening solution to remove said solution and said resin bleed from said encapsulated electronic component, said rinsing including passing said encapsulated electronic component through at least one low pressure rinse station in which a liquid is sprayed at low pressure to remove resin bleed-loosening solution from said encapsulated electronic component.

5. A method for removing resin bleed and other material from the leadframe of an encapsulated electronic component, said method comprising the steps of:

loading said encapsulated electronic component onto a transporting member for transporting said encapsulated electronic component through the steps of said method;

passing said encapsulated electronic component through a resin bleed-loose solution in order to electrolytically loosen said resin bleed on the leadframe of said encapsulated electronic component;

rinsing said encapsulated electronic component after said encapsulated electronic component has been passed through said resin bleed-loosening solution to remove said solution and said resin bleed from said encapsulated electronic component, said rinsing including passing said encapsulated electronic component through at least one high pressure rinse station in which a plurality of nozzles are positioned for spraying a liquid under high pressure at both sides of said encapsulated electronic component to remove resin bleed and resin bleed-loosening solution from said encapsulated electronic component.

6. The method for removing resin bleed and other materials of claim 5 further comprising the step of oscillating at least a portion of said plurality of nozzles in said high pressure rinse station in a vertical plane to enable said nozzles to completely blanket the encapsulated electronic component with a high pressure spray.

* * * * *